US008132974B2

(12) United States Patent
Sawai et al.

(10) Patent No.: US 8,132,974 B2
(45) Date of Patent: Mar. 13, 2012

(54) IMAGE GENERATING APPARATUS

(75) Inventors: Kunio Sawai, Daito (JP); Takahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1080 days.

(21) Appl. No.: 12/021,726

(22) Filed: Jan. 29, 2008

(65) Prior Publication Data

US 2008/0199238 A1 Aug. 21, 2008

(30) Foreign Application Priority Data

Jan. 31, 2007 (JP) ..... 2007-22122

(51) Int. Cl.
*B41J 2/335* (2006.01)

(52) U.S. Cl. ..... 400/120.16; 347/197

(58) Field of Classification Search ..... 400/120.16, 400/120.17; 347/197, 198
See application file for complete search history.

(56) References Cited

U.S. PATENT DOCUMENTS 7,471,303 B2 * 12/2008 Sawai ..... 347/197

FOREIGN PATENT DOCUMENTS

| | | | |
|---|---|---|---|
| JP | 9-188027 | A | 7/1997 |
| JP | 3005916 | B2 | 11/1999 |
| JP | 2607240 | Y2 | 3/2001 |
| JP | 2001-322304 | A | 11/2001 |

* cited by examiner

*Primary Examiner* — Leslie J Evanisko
(74) *Attorney, Agent, or Firm* — Crowell & Moring LLP

(57) ABSTRACT

An image generating apparatus includes a print portion printing a paper, a platen roller arranged so as to be opposed to the print portion, a heat radiating member mounted on the print portion, radiating heat generated in the print portion, integrally provided with a plate-like support shaft as an axis of rotation and rotatable in a direction for coming into pressure contact with or separating from the platen roller, a regulating member regulating movement of the print portion in a printing direction of the paper, a chassis having a hole-shaped bearing receiving the plate-like support shaft, and a side plate mounted on the chassis.

15 Claims, 17 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a heat radiating member radiating heat generated in a print portion.

2. Description of the Background Art

An image generating apparatus comprising a heat radiating member radiating heat generated in a print portion is known in general, as disclosed in each of Japanese Patent No. 3005916, Japanese Patent Laying-Open No. 9-188027 (1997), Japanese Utility Model Registration No. 2607240 and Japanese Patent Laying-Open No. 2001-322304.

The aforementioned Japanese Patent No. 3005916 discloses a thermosensitive recording apparatus (image generating apparatus) comprising a radiator plate (heat radiating member) mounted on a thermal head (print portion), a platen roller, a pressing member pressing a rear surface of the radiator plate so as to bring the thermal head into pressure contact with the platen roller, and a pressure releasing lever having a cam shaped portion separating the thermal head from the platen roller. In the thermosensitive recording apparatus described in Japanese Patent No. 3005916, the cam shaped portion of the pressure releasing lever rotates about the platen roller functioning as an axis of rotation so that the thermal head in pressure contact with the platen roller is pressed in a direction opposite to a pressure contact direction with the cam shaped portion presses and the thermal head is separated from the platen roller. No rotating shaft is provided on the radiator plate mounted on the thermal head.

The aforementioned Japanese Patent Laying-Open No. 9-188027 discloses a thermal transfer printer (image generating apparatus) comprising a radiator fin (heat radiating member) mounted on a thermal head (print portion), a platen roller, and a head arm rotatable in a direction in which the thermal head is brought into pressure contact with or separated from the platen roller. In the thermal transfer printer described in Japanese Patent Laying-Open No. 9-188027 (1997), the head arm rotates about a round shaft provided on an end of the head arm as an axis of rotation The aforementioned Japanese Utility Model Registration No. 2607240 discloses a thermal printer (image generating apparatus) comprising a heat sink (heat radiating member) mounted on a thermal head (print portion), a platen (platen roller), a head pressing spring pressing the thermal head against the platen, a bush mounted on an end of the heat sink, a head up lever rotating the heat sink about the bush as an axis of rotation so as to separate the thermal head from the platen. In the thermal printer described in Japanese Utility Model Registration No. 2607240, the bush functioning as the axis of rotation regulates movement of the thermal head generated with force pressing the thermal head against the platen and force in a transport direction for a paper in printing.

The aforementioned Japanese Patent Laying-Open No. 2001-322304 discloses a thermal printer (image generating apparatus) comprising a radiator plate (heat radiating member) mounted on a thermal head (print portion), a platen (platen roller), a coil spring pressing a thermal head against a platen, and a shaft portion as an axis of rotation of a radiator plate rotating so as to bringing the thermal head into pressure contact with the platen separate or separating the thermal head from the platen. In the thermal printer described in Japanese Patent Laying-Open No. 2001-322304, the shaft portion functioning as the axis of rotation regulates movement of the thermal head generated with force pressing the thermal head against the platen and force in a transport direction for a paper in printing.

In the thermosensitive recording apparatus described in the aforementioned Japanese Patent No. 3005916, however, the radiator plate is rotated with pressing force pressing from the rear surface of the radiator plate with the pressing member and pressing force pressing from a from surface of the radiator plate with the cam shaped portion. In this case, no rotating shaft is provided on the radiator plate and hence the radiator plate can not be stably rotated. Consequently, the thermal head can not be disadvantageously stably brought into pressure contact with or separated from the platen roller.

The thermal transfer printer described in the aforementioned Japanese Patent Laying-Open No. 9-188027, the head arm rotates about the round shaft provided on the end of the head arm as the axis of rotation, and hence the round shaft must be separately mounted on the head arm. Thus, the number of components of the shaft portion is disadvantageously increased due to the separately required round shaft.

In the thermal printers described in the aforementioned Japanese Utility Model Registration No. 2607240 and Japanese Patent Laying-Open No. 2001-322304, the bush and the shaft portion functioning as the axes of rotation respectively regulate the movement of the thermal head in printing and hence the bush and the shaft portion each must have both a function as the axis of rotation and a function of regulating the movement of the thermal head in printing. Thus, the bush and the shaft portion as the axes of rotation must be disadvantageously formed with high accuracy.

SUMMARY OF THE INVENTION

The present invention has been proposed in order to solve the aforementioned problems, and an object of the present invention is to provide an image generating apparatus capable of stably bringing a print portion into pressure contact with a platen roller or separating the print portion from the platen roller and having no requirement for working a rotating shaft with high dimensional accuracy while suppressing increase in the number of components.

An image generating apparatus according to a first aspect of the present invention comprises a print portion printing a paper, a platen roller arranged so as to be opposed to the print portion, a heat radiating member mounted on the print portion, radiating heat generated in the print portion, integrally provided with a plate-like support shaft as an axis of rotation and rotatable in a direction for coming into pressure contact with or separating from the platen roller, a regulating member regulating movement of the print portion in a printing direction of the paper, a chassis having a hole-shaped bearing receiving the plate-like support shaft, and a side plate mounted on the chassis.

In the image generating apparatus according to the first aspect, as hereinabove described, the image generating apparatus is provided with the heat radiating member mounted on the print portion, radiating heat generated in the print portion, provided integrally with the plate-like support shaft as the axis of rotation and rotatable in the direction for coming into pressure contact with or separating from the platen roller, and the chassis having the hole-shaped bearing receiving the plate-like support shaft, whereby no support shaft may be separately mounted and the heat radiating member can be stably rotated about the support shaft. Thus, the print portion can be stably brought into pressure contact with or separated from the platen roller while suppressing increase in the number of components of the shaft portion. In this image generating apparatus, the regulating member regulating the movement of the print portion in the printing direction of the paper is provided, whereby no function regulating the movement of the print portion may be provided in the support shaft serving as the axis of rotation, and hence the support shaft serving as the axis of rotation and the hole-shaped bearing may not be worked with high dimensional accuracy.

In the aforementioned image generating apparatus according to the first aspect, the side plate preferably integrally includes a contact portion capable of limiting movement of the heat radiating member of the support shaft in an axial direction, and the contact portion is preferably so formed as to be elastically deformable in a direction intersecting with the axial direction of the support shaft up to a position where the contact portion does not come into contact with the plate-like support shaft inserted into the hole-shaped bearing. According to this structure, the contact portion can be deformed so as not to come into contact with the support shaft when the plate-like support shaft is inserted into the hole-shaped bearing and hence the plate-like support shaft can be easily inserted into the hole-shaped bearing.

In this case, the contact portion is preferably provided on the side plate across the hole-shaped bearing. According to this structure, the plate-like support shaft inserted into the hole-shaped bearing is easily brought into contact with the contact portion and hence the contact portion can easily regulate the movement of the support shaft in the axial direction.

In the aforementioned image generating apparatus according to the first aspect, the hole-shaped bearing receiving the plate-like support shaft is preferably formed in a sectorial shape. According to this structure, the plate-like support shaft can be rotated about the sectorial end as the supporting point and hence the heat radiating member can be further stably rotated.

In the aforementioned image generating apparatus according to the first aspect, the plate-like support shaft preferably includes first and second support shafts integrally provided on the heat radiating member so as to protrude outward from first and second end surface portions of the heat radiating member respectively, and the length from an end of the second support shaft provided on the second end surface portion of the heat radiating member to the first end surface portion of the heat radiating member is preferably smaller than the length from a first side surface of the chassis to a second side surface of the chassis. According to this structure, the end of the second support shaft is located inside the second side surface of the chassis when the first support shaft is inserted into the hole-shaped bearing of the first side surface of the chassis up to a position where the first end surface portion of the heat radiating member comes into contact with the first side surface of the chassis, and hence the second support shaft can be easily inserted into the hole-shaped bearing of the second side surface of the chassis.

The aforementioned image generating apparatus according to the first aspect is preferably provided with a feed roller transporting the paper, wherein the regulating member is preferably so formed as to function as a bearing of the feed roller. According to this structure, the regulating member and the bearing of the feed roller may not be provided separately from each other and hence increase in the number of components can be suppressed.

In this case, the regulating member functioning as the bearing of the feed roller preferably includes a protrusion protruding toward the print portion. According to this structure, the print portion moving in the printing direction of the paper in printing can be easily brought into contact with the protrusion of the regulating member, and hence the movement of the print portion in the printing direction of the paper can be easily regulated.

The aforementioned image generating apparatus according to the first aspect preferably further comprises a pressing member rotatably formed and pressing the print portion toward the platen roller, wherein a pushed-up portion pushed up with the pressing member when the pressing member rotates is preferably integrally provided on the heat radiating member, and the pushed-up portion of the heat radiating member is preferably pushed up with the pressing member when the pressing member rotates so that the heat radiating member and the print portion rotate in a direction for separating from the platen roller. According to this structure, the pushed-up portion is pushed up with rotating force of the pressing member when the pressing member rotates without separately providing a transfer mechanism portion transmitting rotating force of the pressing member to the heat radiating member and the print portion and the heat radiating member and the print portion can be easily rotated in the direction for separating from the platen roller. Consequently, increase in the number of components can be suppressed.

In this case, the pressing member preferably presses the print portion toward the platen roller in printing, and the heat radiating member preferably includes a deviation stopper preventing the pressing member from deviating in a rotational direction when the pressing member presses the print portion toward the platen roller in printing. According to this structure, the pressing member does not deviate in the rotational direction in printing and hence the pressing member can reliably press the print portion toward the platen roller.

In the aforementioned structure comprising the pressing member, the pressing member is preferably made of resin. According to this structure, noise can be suppressed also when the pressing member slides with respect to the rotating shaft made of metal at the time of rotation of the pressing member, as compared with a case where the pressing member is made of metal.

An image generating apparatus according to a second aspect of the present invention comprises a print portion printing a paper, a platen roller arranged so as to be opposed to the print portion, a heat radiating member mounted on the print portion and radiating heat generated in the print portion, a regulating member regulating movement of the print portion in a printing direction of the paper, a chassis, a side plate mounted on the chassis, and a feed roller transporting the paper. The heat radiating member is formed integrally with a plate-like support shaft as an axis of rotation and rotates in a direction for coming into pressure contact with or separating from the platen roller, and the chassis has a sectorial hole-shaped bearing receiving the plate-like support shaft. The side plate integrally includes a contact portion capable of limiting movement of the support shaft of the heat radiating member in an axial direction, and the contact portion is elastically deformed in a direction intersecting with the axial direction of the support shaft up to a position where the contact portion does not come into contact with the plate-like support shaft inserted into the hole-shaped bearing. The plate-like support shaft includes first and second support shafts integrally provided on the heat radiating member so as to protrude outward from first and second end surface portions of the heat radiating member respectively, the length from an end of the second support shaft provided on the second end surface portion of the heat radiating member to the first end surface portion of the heat radiating member is smaller than the length from a first side surface of the chassis to a second side surface of the chassis, and the regulating member is so formed as to function as a bearing of the feed roller.

In the image generating apparatus according to the second aspect, as hereinabove described, the image generating apparatus is provided with the heat radiating member mounted on the print portion, radiating heat generated in the print portion, provided integrally with the plate-like support shaft as the axis of rotation and rotatable in the direction for coming into pressure contact with or separating from the platen roller, and the chassis having the hole-shaped bearing receiving hole receiving the plate-like support shaft, whereby no support shaft may be separately mounted and the heat radiating member can be stably rotated about the support shaft. Thus, the print portion can be stably brought into pressure contact with or separated from the platen roller while suppressing increase in the number of components of the shaft portion. In this image generating apparatus, the regulating member regulating the movement of the print portion in the printing direction of the paper is provided, whereby no function regulating the movement of the print portion may be provided in the support shaft serving as the axis of rotation, and hence the support shaft serving as the axis of rotation and the hole-shaped bearing may not be worked with high dimensional accuracy.

In the image generating apparatus according to the second aspect, the side plate integrally includes a contact portion capable of limiting movement of the support shaft of the heat radiating member in an axial direction, and the contact portion is so formed as to be elastically deformable in a direction intersecting with the axial direction of the support shaft up to a position where the contact portion does not come into contact with the plate-like support shaft inserted into the hole-shaped bearing, whereby the contact portion can be deformed so as not to come into contact with the support shaft when the plate-like support shaft is inserted into the hole-shaped bearing and hence the plate-like support shaft can be easily inserted into the hole-shaped bearing. The hole-shaped bearing receiving the plate-like support shaft is formed in a sectorial shape, whereby the plate-like support shaft can be rotated about the sectorial end as the supporting point and hence the heat radiating member can be further stably rotated. The plate-like support shaft is provided so as to protrude outward from first and second end surface portions of the heat radiating member respectively, and the length from an end of the second support shaft provided on the second end surface portion of the heat radiating member to the first end surface portion of the heat radiating member is smaller than the length from a first side surface of the chassis to a second side surface of the chassis, whereby the end of the second support shaft is located inside the second side surface of the chassis when the first support shaft is inserted into the hole-shaped bearing of the first side surface of the chassis up to a position where the first end surface portion of the heat radiating member comes into contact with the first side surface of the chassis, and hence the second support shaft can be easily inserted into the hole-shaped bearing of the second side surface of the chassis. The feed roller transporting the paper is provided and the regulating member is so formed as to function as the bearing of the feed roller, whereby the regulating member and the bearing of the feed roller may not be provided separately from each other and hence increase in the number of components can be suppressed.

In the aforementioned image generating apparatus according to the second aspect, the contact portion is preferably provided on the side plate across the hole-shaped bearing. According to this structure, the plate-like support shaft inserted into the hole-shaped bearing can be easily brought into contact with the contact portion and hence the contact portion can easily regulate the movement of the support shaft in the axial direction.

In the aforementioned image generating apparatus according to the second aspect, the regulating member functioning as the bearing of the feed roller preferably includes a protrusion protruding toward the print portion. According to this structure, the print portion moving in the printing direction of the paper in printing can be easily brought into contact with the protrusion of the regulating member, and hence the movement of the print portion in the printing direction of the paper can be easily regulated.

The aforementioned image generating apparatus according to the second aspect preferably further comprising a pressing member rotatably formed and pressing the print portion toward the platen roller, wherein a pushed-up portion pushed up with the pressing member when the pressing member rotates is integrally provided on the heat radiating member, and the pushed-up portion of the heat radiating member is pushed up with the pressing member when the pressing member rotates so that the heat radiating member and the print portion rotate in a direction for separating from the platen roller. According to this structure, the pushed-up portion is pushed up with rotating force of the pressing member when the pressing member rotates without separately providing a transfer mechanism portion transmitting rotating force of the pressing member to the heat radiating member and the print portion and the heat radiating member and the print portion can be easily rotated in the direction for separating from the platen roller. Consequently, increase in the number of components can be suppressed.

In this case, the pressing member preferably presses the print portion toward the platen roller in printing, the heat radiating member preferably includes a deviation stopper preventing the pressing member from deviating in a rotational direction when the pressing member presses the print portion toward the platen roller in printing. According to this structure, the pressing member does not deviate in the rotational direction in printing and hence the pressing member can reliably press the print portion toward the platen roller.

In the aforementioned structure comprising the pressing member, the pressing member is preferably made of resin. According to this structure, noise can be suppressed also when the pressing member slides with respect to the rotating shaft made of metal at the time of rotation of the pressing member, as compared with a case where the pressing member is made of metal.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be hereinafter described with reference to the drawings.

First Embodiment

A structure of a dye sublimation printer 100 according to the first embodiment of the present invention will be now described with reference with FIGS. 1 to 15. According to the first embodiment, the present invention is applied to the dye sublimation printer employed as an exemplary image generating apparatus.

Figure 1:
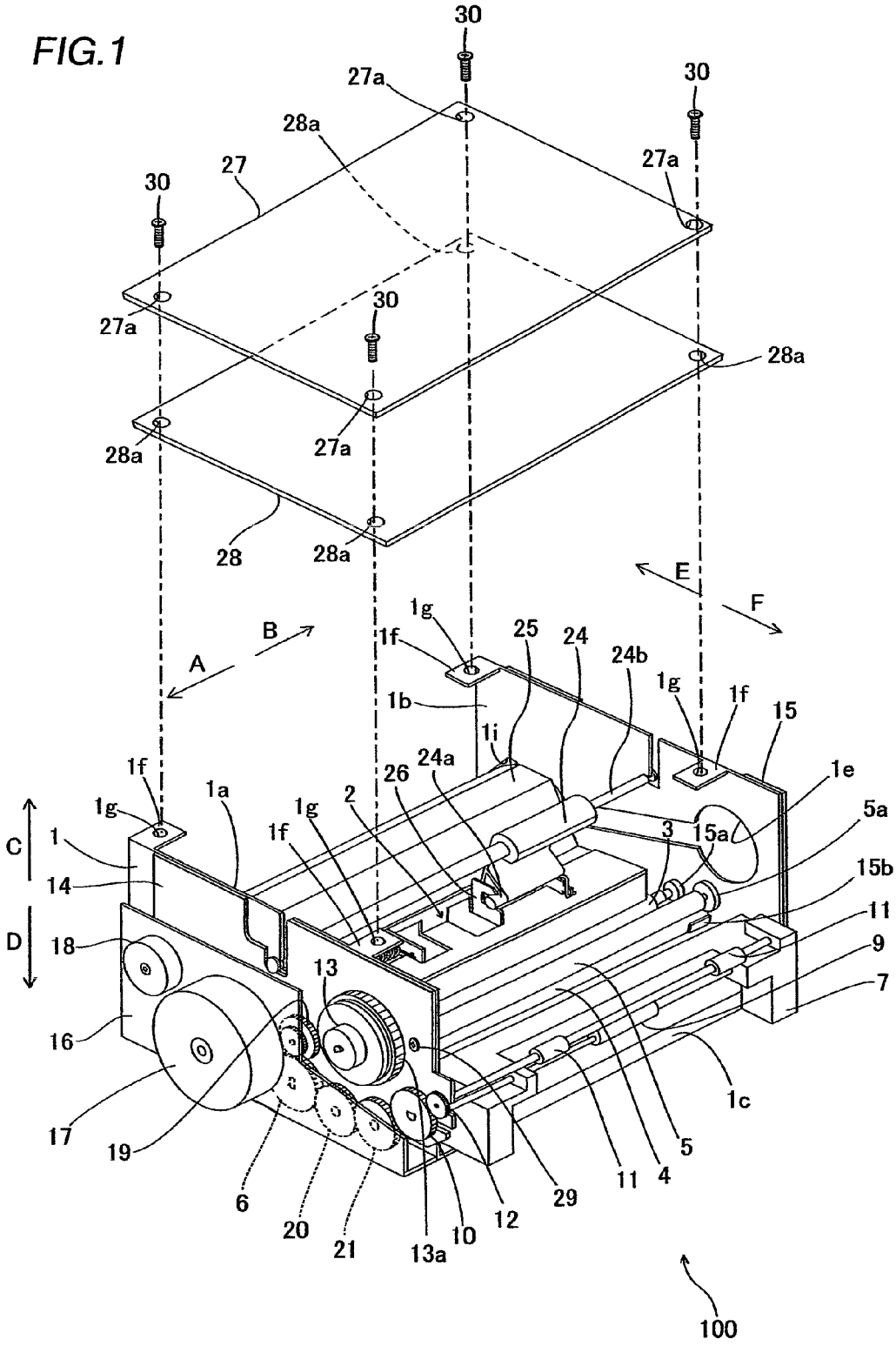
FIG. 1 is a perspective view showing an overall structure of a dye sublimation printer according to a first embodiment of the present invention.
Figure 2:
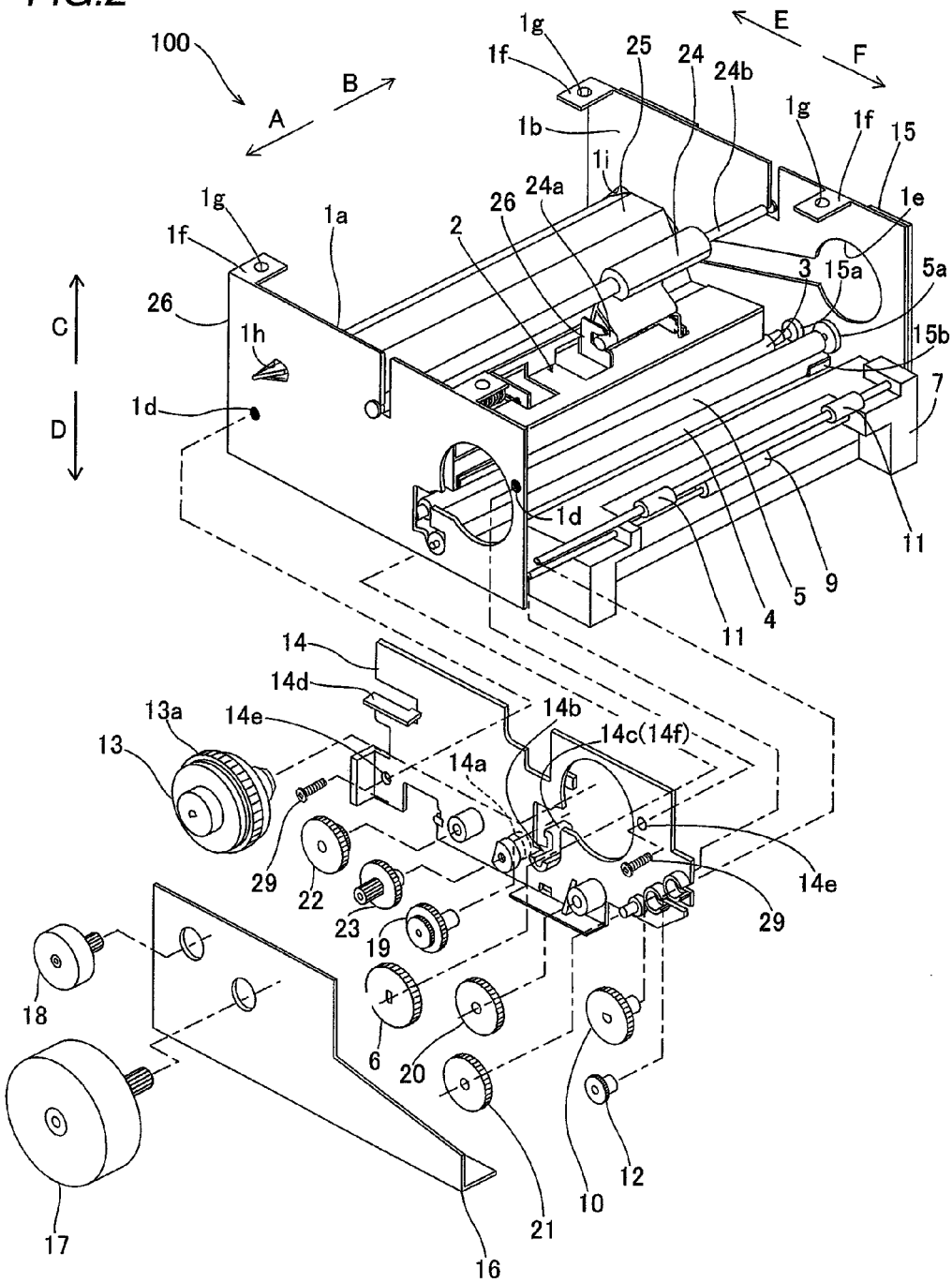
FIG. 2 is an exploded perspective view of the dye sublimation printer according to the first embodiment of the present invention shown in FIG. 1.

As shown in FIGS. 1 and 2, the dye sublimation printer 100 according to the first embodiment of the present invention comprises a chassis 1 made of metal, a print head 2 for printing, a platen roller 3 opposed to the print head 2, a feed roller 4 made of metal, a press roller 5 for pressing the feed roller 4 with prescribed pressing force, a feed roller gear 6, a lower paper guide 7 made of resin, an upper paper guide 8 (see FIG. 5) made of resin, a paper feed roller 9 of rubber and a paper feed roller gear 10. The print head 2 is an example of the "print portion" in the present invention.

The dye sublimation printer 100 further comprises a paper discharge roller 11 made of rubber, a paper discharge roller gear 12, a take-up reel 13, side plates 14 and 15 made of resin, a motor bracket 16, a stepping motor 17 for transporting papers 40 (see FIG. 5) described later, another stepping motor 18 serving as a driving source for rotating the print head 2, a swingable swing gear 19, a plurality of intermediate gears 20 to 23 and a pressing member 24 for pressing the print head 2.

The dye sublimation printer 100 further comprises a heat sink 25 mounted on the print head 2 and radiating heat generated in the print head 2, an engaging member 26 mounted on an upper surface of the heat sink 25 and so formed as to engage with a protrusion 24*a* of a pressing member 24, a wiring board 27 provided with a circuit portion (not shown) controlling an operation of the dye sublimation printer 100 and a top plate 28. The heat sink 25 is an example of the "heat radiating member" in the present invention.

The chassis 1 has a first side surface 1*a* and a second side surface 1*b* opposed to each other and a bottom surface 1*c*. Threaded holes 1*d* (see FIG. 2) receiving screws 29 for mounting the side plate 14 made of resin are provided on the first side surface 1*a* of the chassis 1. A receiving hole le for receiving an ink sheet cartridge 50 (see FIG. 5) storing an ink sheet 51 is provided on the second side surface 1*b* of the chassis 1. Pairs of mounting portions if for mounting the circuit board 27 are formed on the upper ends of the first and second side surfaces 1*a* and 1*b* of the chassis 1 respectively 1, while threaded holes 1*g* receiving screws 30 for fixing the wiring board 27 are formed on the four mounting portions if respectively.

According to the first embodiment, a receiving hole 1*h* receiving a support shaft 25*a* of the heat sink 25 described later is formed on the first side surface 1*a* of the chassis 1, as shown in FIG. 2. A receiving hole 1*i* receiving a support shaft 25*b* of the heat sink 25 described later is formed on the second side surface 1*b*. Paper sensors 31*a* and 31*b* (see FIG. 5) for detecting front and rear ends of each paper 40 are provided on the bottom surface 1*c* of the chassis 1. The receiving holes 1*h* and 1*i* are examples of the "bearing" in the present invention.

The platen roller 3 is rotatably supported with platen roller bearings 14*a* (see FIG. 2) and 15*a* (see FIG. 3) integrally provided on the side plates 14 and 15 mounted on the first and second side surfaces 1*a* and 1*b* of the chassis 1 respectively.

Figure 3:
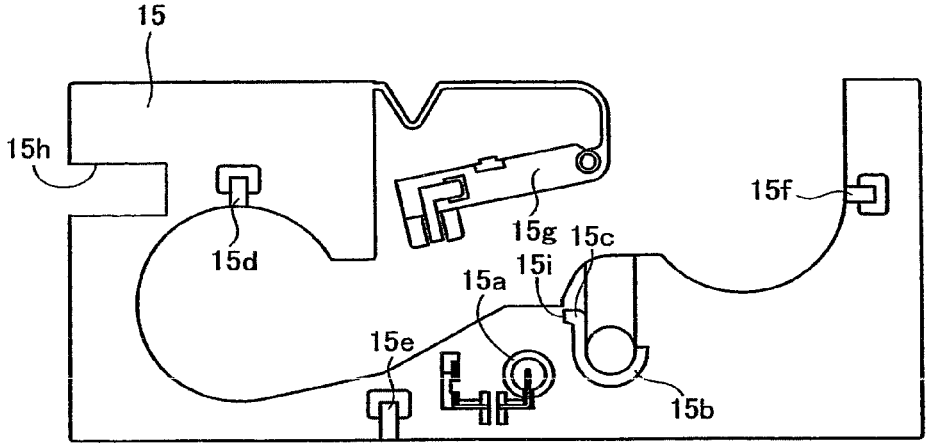
FIG. 3 is a diagram showing a side plate of the dye sublimation printer according to a first embodiment of the present invention shown in FIG. 1.

According to the first embodiment, the feed roller 4 is rotatably supported with after-mentioned feed roller bearing 14*b* and 15*b* integrally provided on the side plates 14 and 15 respectively, as shown in FIGS. 2 and 3. A first end of the feed roller 4 is mounted on the feed roller gear 6 through the first side surface 1*a* of the chassis 1 and the side plate 14. The press roller 5 is rotatably supported by a press roller bearings 5*a* (see FIGS. 1 and 2) provided on both ends. The feed roller 4 and the press roller 5 rotate in a state of holding each paper 40 therebetween, thereby transporting the paper 40 in a paper feed direction (along arrow T1 in FIG. 5) or a paper discharge direction (along arrow U1 in FIG. 6).

Figure 5:
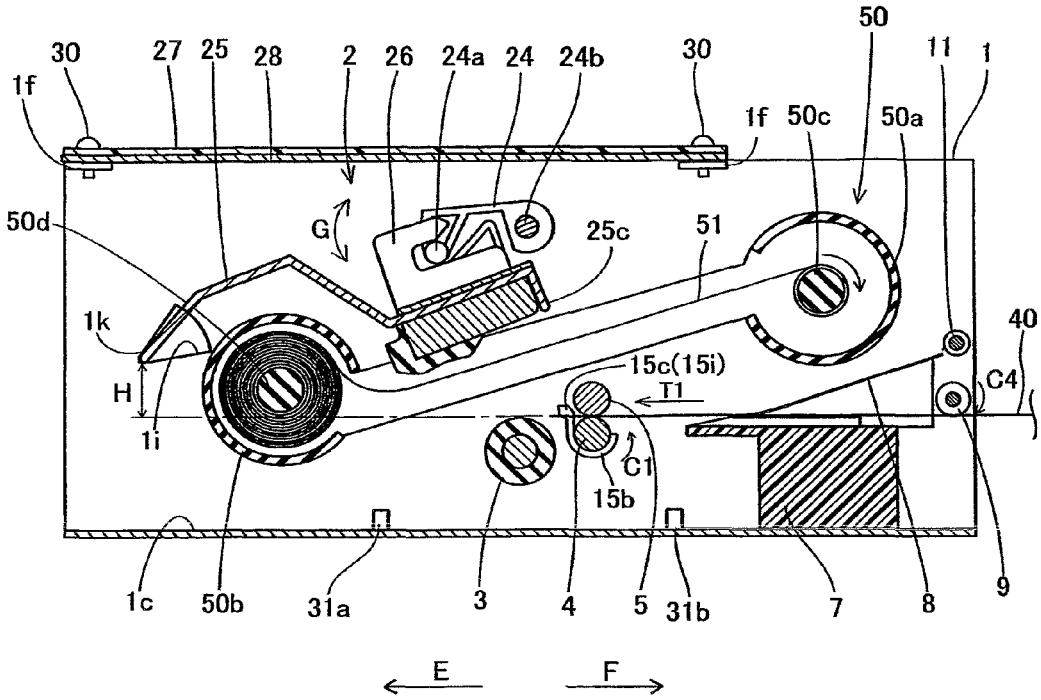
FIGS. 5 and 6 are sectional views of the dye sublimation printer according to the first embodiment of the present invention shown in FIG. 1.

As shown in FIG. 2, the paper feed roller gear 10 is mounted on a first end of the paper feed roller 9 through the side plate 14 and the first side surface 1*a* of the chassis 1. As shown in FIG. 5, the paper feed roller 9 has a function of introducing the papers 40 stored in a paper feed cassette (not shown) into the chassis 1.

As shown in FIG. 2, the paper discharge roller gear 12 is mounted on a first end of the paper discharge rollers 11 through the side plate 14 and the first side surface 1*a* of the chassis 1 similarly to the paper feed roller gear 10. The paper discharge roller 11 has a function of discharging the papers 40 printed by the print head 2 from the chassis 1.

Figure 14:
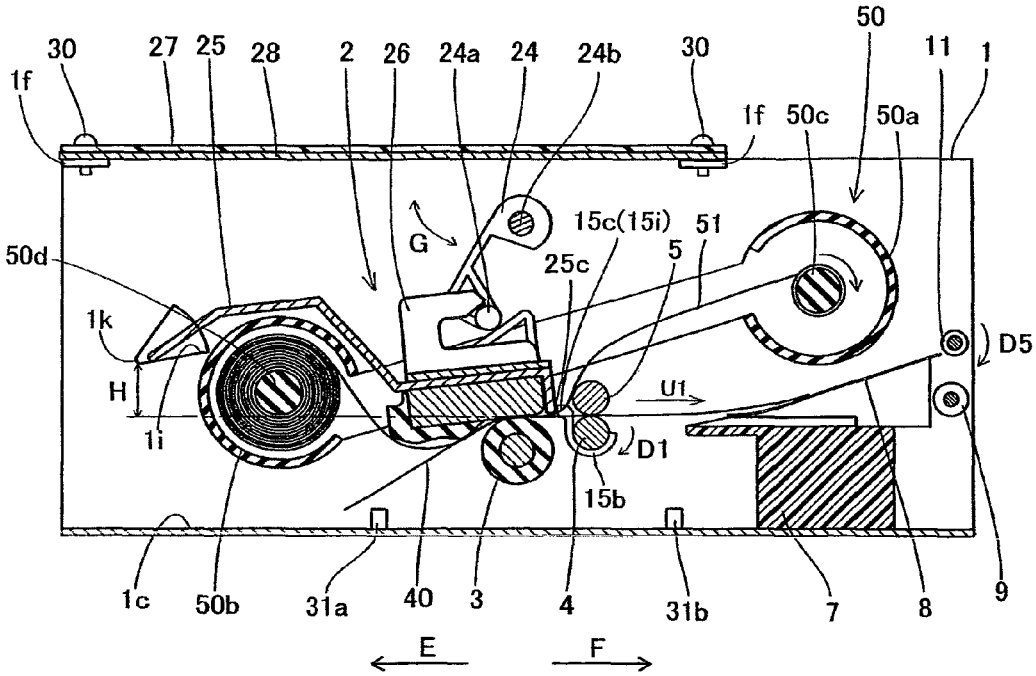
FIG. 14 is a sectional view of the dye sublimation printer according to the first embodiment of the present invention shown in FIG. 1.

The take-up reel 13 is so formed as to engage with a take-up bobbin 50*c* arranged in a take-up portion 50*a* of the ink sheet cartridge 50 shown in FIG. 5 as described later thereby taking up the ink sheet 51 wound on the take-up bobbin 50*c*. The gear portion 13*a* of the take-up reel 13 is so arranged as to mesh with the swingable swing gear 19 upon swinging thereof, as shown in FIG. 14.

According to the first embodiment, a locating portion 14*c* regulating movement of the print head 2 in a printing direction (along arrow U1 in FIG. 6) of each paper 40 is provided integrally with the feed roller bearing 14*b* on the side plate 14, as shown in FIG. 2. The locating portion 14*c* is an example of the "regulating member" in the present invention. The locating portion 14*c* has a protrusion 14*f* protruding toward the print head 2 (along arrow E). The side plate 14 made of resin is provided integrally with a stopper portion 14*d* for movement of the after-mentioned support shaft 25*a* of the heat sink 25 in an axial direction (along arrow A) at a position corresponding to the sectorial receiving hole 1*h* formed on the first side surface 1*a* of the chassis 1. The stopper portion 14*d* is so formed as to be elastically deformable in a downward direction (along arrow D) intersecting with the axial direction (along arrow A) of the support shaft 25*a* up to a position where the stopper portion 14*d* does not come into contact with the support shaft 25*a* inserted into the receiving hole 1*h*. The stopper portion 14*d* is an example of the "contact portion" in the present invention. The side plate 14 is fixed by tightening two screws 29 inserted into two receiving holes 14*e* thereof to the threaded holes 1*d* provided on the first side surface 1*a* of the chassis 1.

As shown in FIG. 3, a locating portion 15*c* regulating movement of the print head 2 in a printing direction (along arrow U1 in FIG. 6) of each paper 40 is provided integrally with the feed roller bearing 15*b* on the side plate 15 made of resin. The locating portion 15*c* is an example of the "regulating member" in the present invention. The locating portion 15*c* has a protrusion 15*i* protruding toward the print head 2 (along arrow E). The side plate 15 is mounted on the second side surface 1*b* of the chassis 1 with hooked stop sections 15*d*, 15*e* and 15*f* provided integrally with the side plate 15. The side plate 15 is further provided with a retaining stopper 15*g* for preventing the ink sheet cartridge 50 from falling off and a notch 15*h* at a position corresponding to the sectorial receiving hole 1*i* formed on the second side surface 1*b* of the chassis 1.

Figure 4:
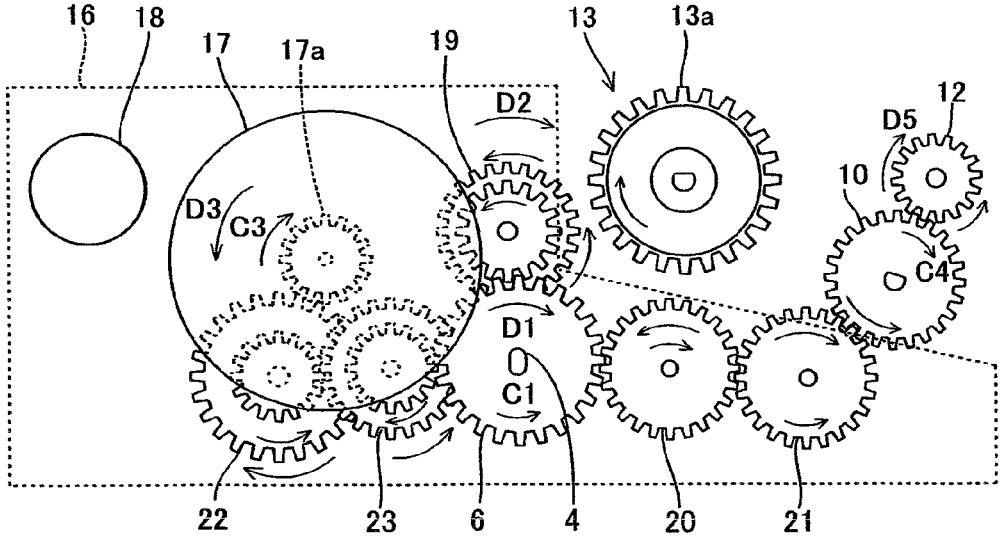
FIG. 4 illustrates the arrangement of gears included in the dye sublimation printer according to the first embodiment of the present invention shown in FIG. 1.

As shown in FIG. 4, a motor gear 17*a* is mounted on the shaft portion of the stepping motor 17 mounted on the motor bracket 16. The stepping motor 17 has a function as the driving source for driving a gear portion 13*a* of the take-up reel 13, the paper feed roller gear 10, the paper discharge roller gear 12 and the feed roller gear 6. The stepping motor 18 is so formed as to rotate the pressing member 24 about a rotating shaft 24*b* along arrow G shown in FIG. 5.

As shown in FIGS. 2 and 4, intermediate gears 20 to 23 are mounted on the side plate 14 in order to transmit driving force of the stepping motor 17 to the feed roller gear 6, the paper feed roller gear 10 and the paper discharge roller gear 12.

Figure 7:
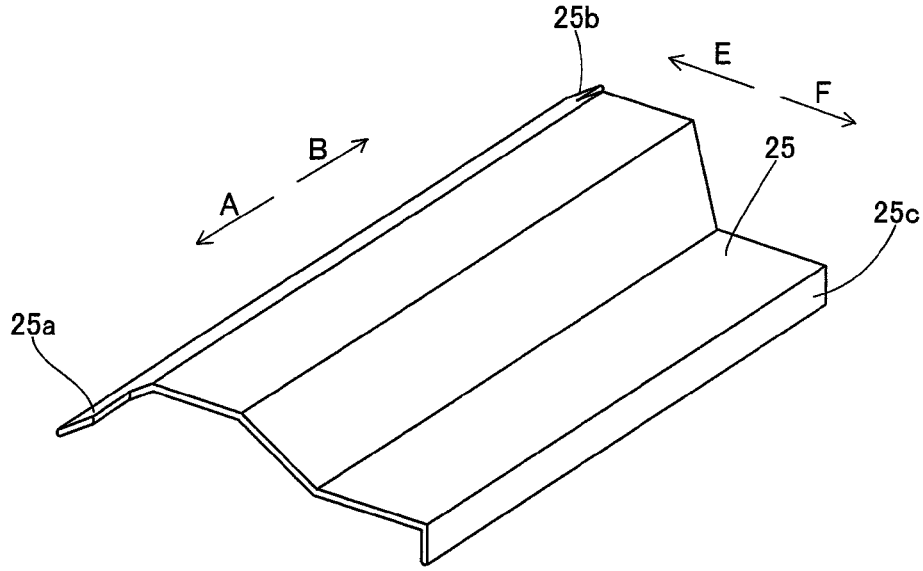
FIGS. 7 and 8 are perspective views showing a heat sink of the dye sublimation printer according to the first embodiment of the present invention shown in FIG. 1.
Figure 8:
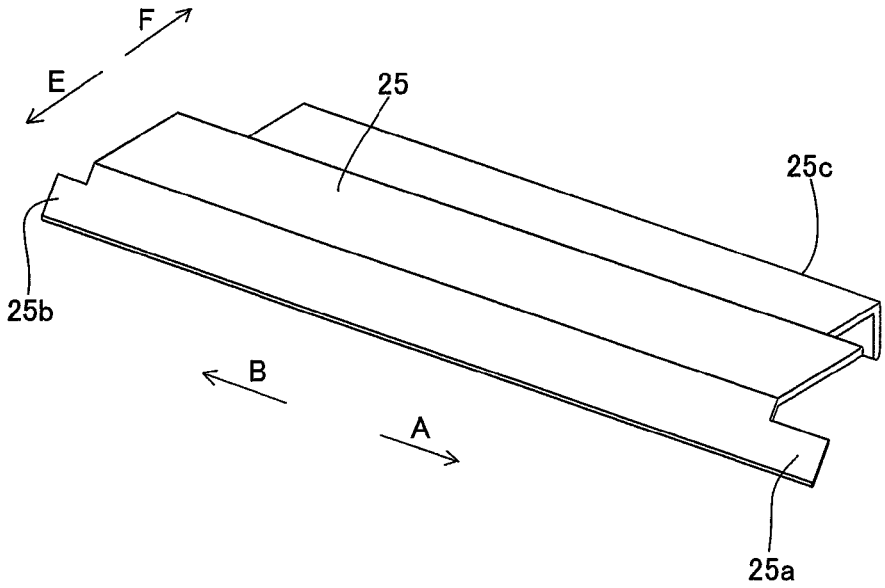

According to the first embodiment, the heat sink 25 is provided integrally with plate-like support shafts 25*a* and 25*b* protruding outward from first and second end surface portions along arrow E respectively and a contact portion 25*c* along arrow F. More specifically, the support shaft 25*a* is provided on the first end surface portion (end along arrow A) of the heat sink 25 and the support shaft 25*b* is provided on the second end surface portion (end along arrow B), as shown in FIGS. 7 to 9.

Figure 6:
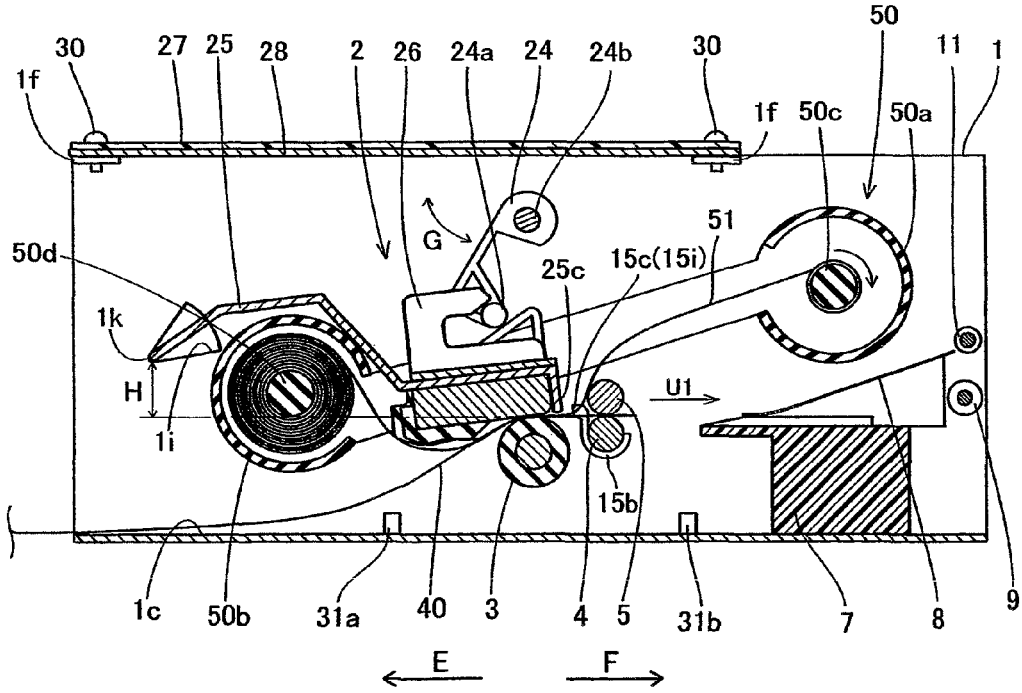
Figure 10:
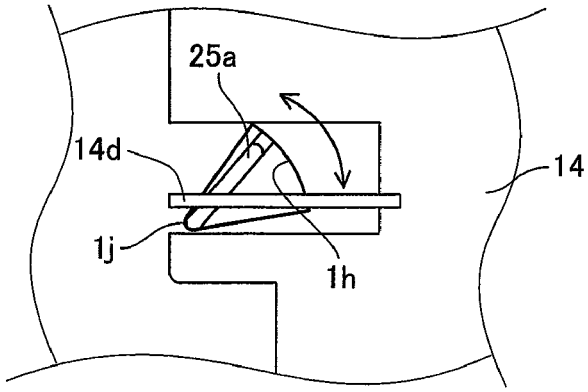
FIGS. 10 and 11 are enlarged views showing a stopper portion of the dye sublimation printer according to the first embodiment of the present invention shown in FIG. 1.
Figure 11:
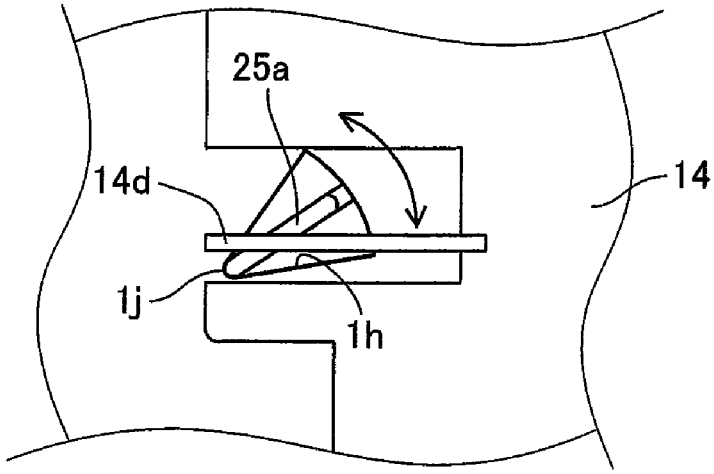

As shown in FIGS. 5, 6, 10 and 11, the pressing member 24 rotates about the rotating shaft 24*b* along arrow G so that the heat sink 25 is rotated about the plate-like support shafts 25*a* and 25*b* as the axis of rotation in a direction for coming into pressure contact with or separating from the platen roller 3. More specifically, the protrusion 24*a* of the pressing member 24 engages with the engaging member 26 mounted on an upper surface of the heat sink 25. Thus, the heat sink 25 is so formed as to rotate about the plate-like support shafts 25*a* and 25*b* as the axis of rotation employing the sectorial ends 1*j* and 1*k* of the sectorial receiving holes 1*h* and 1*i* as supporting points respectively. The sectorial ends 1*j* and 1*k* serve as the supporting points, whereby the heat sink 25 is stably rotated and hence the print head 2 mounted on the heat sink 25 can be stably brought into pressure contact with or separated from the platen roller 3. The stopper portion 14*d* of the side plate 14 limits movement of the support shaft 25*a* of the heat sink 25 in the axial direction (along arrow A in FIG. 2) in a state where the print head 2 separates from the platen roller 3 as shown in FIGS. 5 and 10. The stopper portion 14*d* further limits the movement of the support shaft 25*a* in the axial direction (along arrow A in FIG. 2) also in a state where the print head 2 is in pressure contact with the platen roller 3 as shown in FIGS. 6 and 11.

Figure 9:
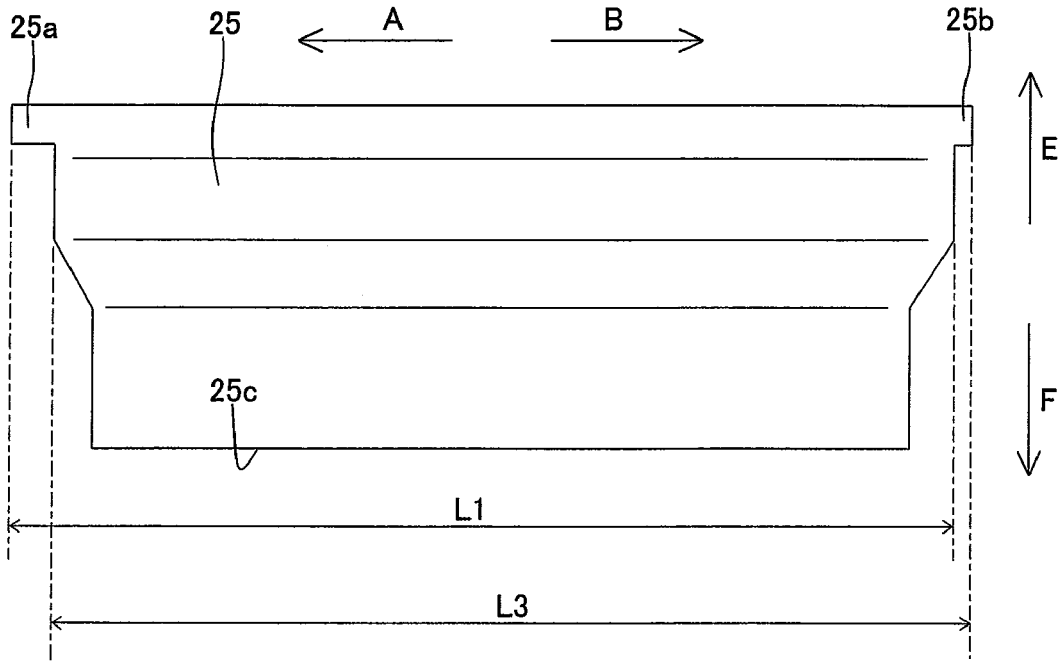
FIG. 9 is a plan view showing the heat sink of the dye sublimation printer according to the first embodiment of the present invention shown in FIG. 1.
Figure 12:
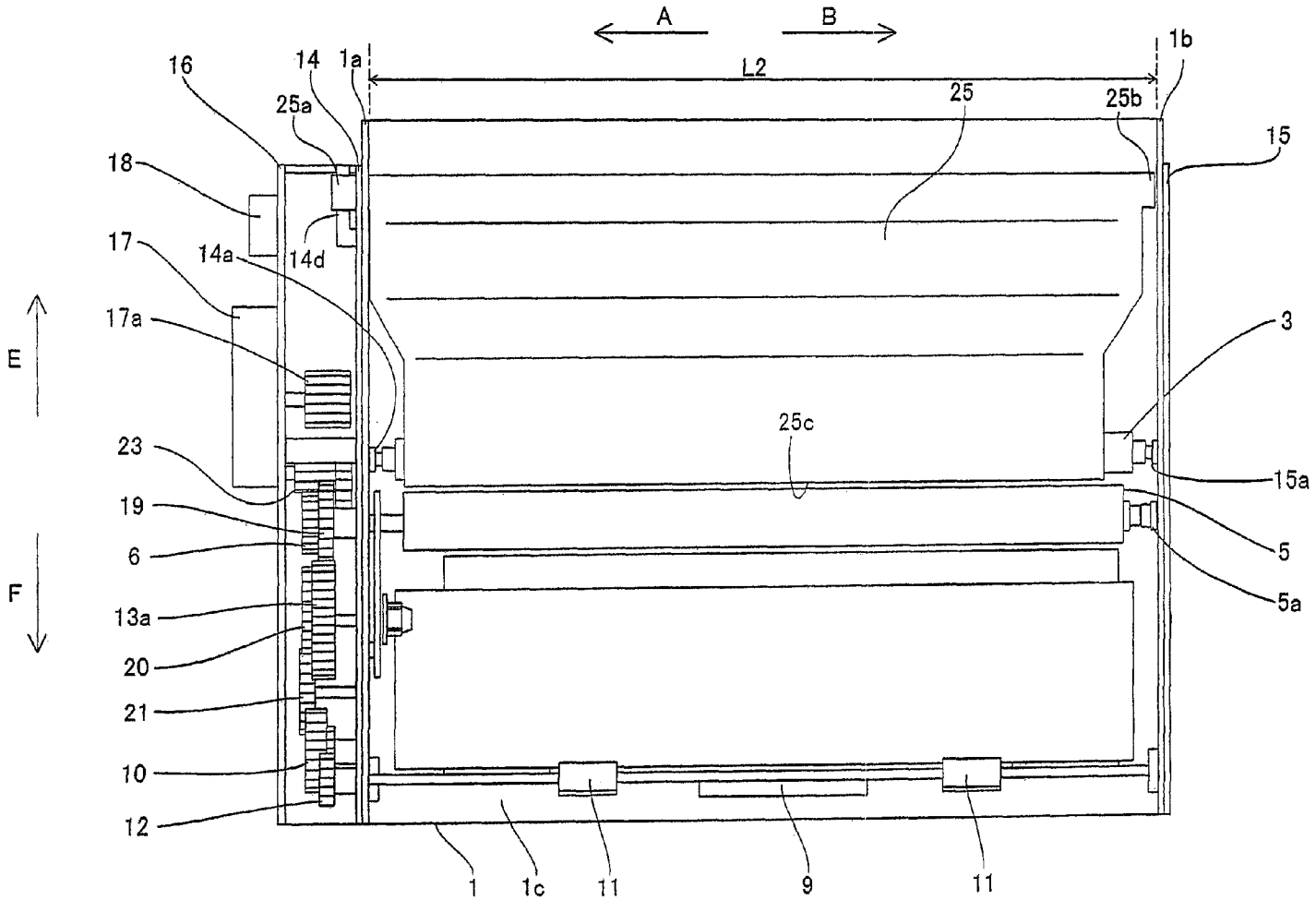
FIGS. 12 and 13 are plan views of the dye sublimation printer according to the first embodiment of the present invention shown in FIG. 1.
Figure 13:
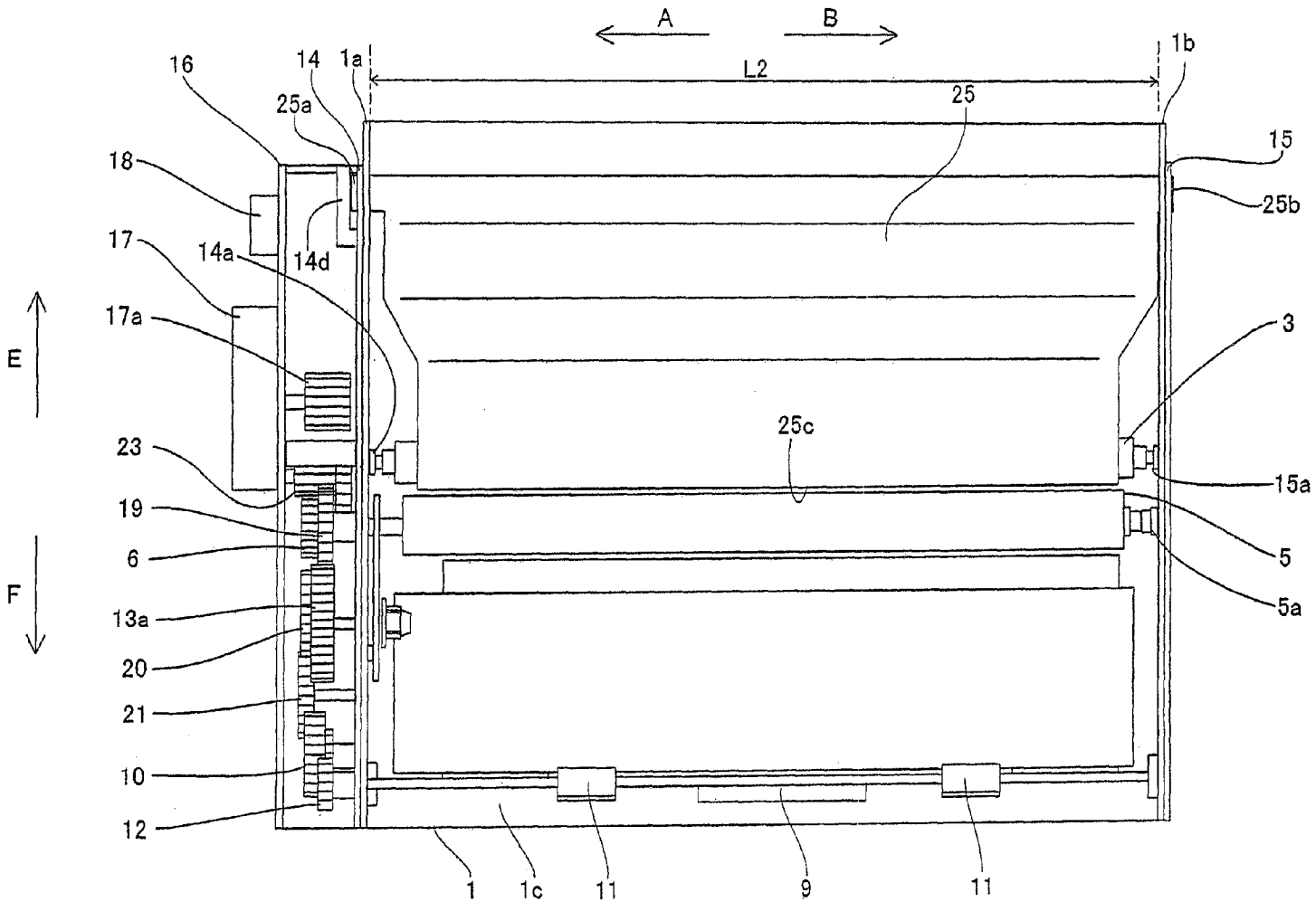

As shown in FIGS. 9, 12 and 13, the length L1 (see FIG. 9) from an end of the support shaft 25*a* provided on the first end surface portion along arrow A to the second end surface portion along arrow B of the heat sink 25 is larger than the length L2 (see FIGS. 12 and 13) from the first side surface 1*a* of the chassis 1 to the second side surface 1*b*. The length L3 (see FIG. 9) from an end of the support shaft 25*b* provided on the second end surface portion along arrow B to the first end surface portion along arrow A of the heat sink 25 is smaller than the length L2 (see FIGS. 12 and 13) from the first side surface 1*a* of the chassis 1 to the second side surface 1*b*. Thus, the end of the support shaft 25*b* is located inside the second side surface 1*b* of the chassis 1 when the support shaft 25*a* is inserted into the receiving hole 1*h* of the first side surface 1*a* up to a position where the first end surface portion along arrow A of the heat sink 25 comes into contact with the first side surface 1*a* of the chassis 1, and hence the support shaft 25*b* can be easily inserted into the receiving hole 1*i* of the second side surface 1*b*.

Figure 15:
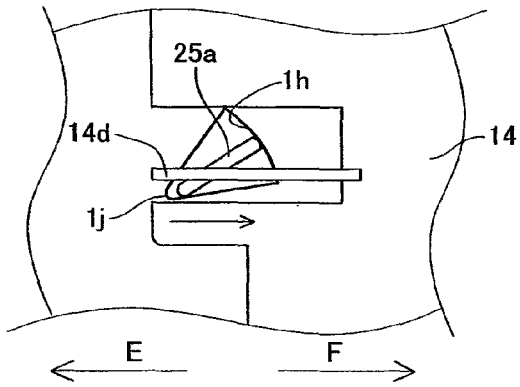
FIGS. 15 and 16 are enlarged views showing the stopper portion of the dye sublimation printer according to the first embodiment of the present invention shown in FIG. 1.

As shown in FIGS. 14 and 15, when the contact portion 25*c* of the heat sink 25 is formed so as to come into contact with the protrusions 14*f* and 15*i* of the locating portions 14*c* and 15*c* provided integrally with the feed roller bearings 14*b* and 15*b* of the side plates 14 and 15 respectively when the print head 2 moves in the printing direction (along arrow U1 in FIG. 14) of each paper 40 in printing. Thus, the movement of the print head 2 in the printing direction (along arrow U1) is regulated and hence the print head 2 can be stably brought into pressure contact with the platen roller 3 irrespective of a separate distance H (see FIG. 14) from the sectorial ends 1*j* and 1*k* serving as the supporting points of the rotation of the print head 2 to a line of action of force moving the print head 2 in the printing direction (along arrow U1).

As shown in FIG. 1, the wiring board 27 is fixed by tightening the four screws 30 inserted into four holes 27*a* of the wiring board 27 and four holes 28*a* of the top plate 28 to the threaded holes 1*g* of the mounting portions 1*f* of the chassis 1.

As shown in FIG. 5, the ink sheet cartridge 50 has the take-up portion 50*a* and a supply portion 50*b*. The take-up bobbin 50*c* is rotatably held in the take-up portion 50*a*. A supply bobbin 50*d* is rotatably arranged in the supply portion 50*b*.

A method of mounting the heat sink 25 of the dye sublimation printer 100 according to the first embodiment will be now described with reference to FIGS. 12, 13 and 16.

Figure 16:
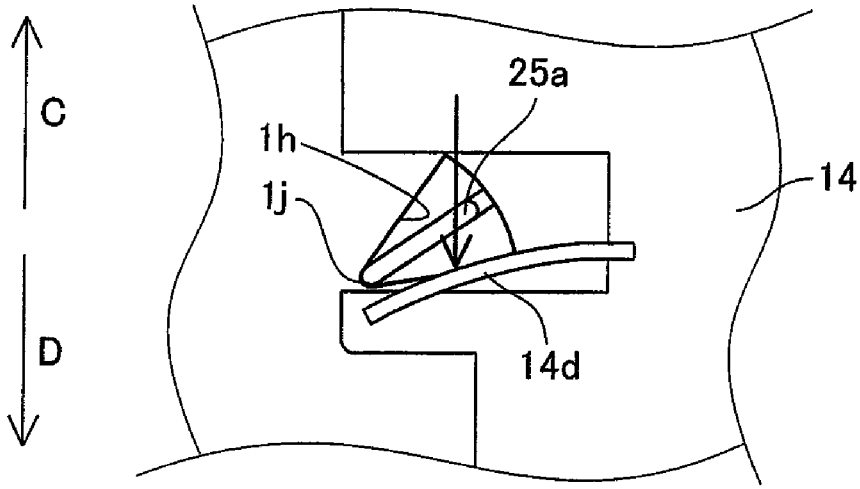

As shown in FIG. 16, the stopper portion 14*d* of the side plate 14 is pressed downward (along arrow D) to be elastically deformed up to the position where the stopper portion 14*d* does not come into contact with the support shaft 25*a* of the heat sink 25. As shown in FIG. 12, the support shaft 25*a* is inserted into the receiving hole 1*h* of the first side surface 1*a* up to the position where the first end surface portion along arrow A of the heat sink 25 comes into contact with the first side surface 1*a* of the chassis 1. Thus, the end of the support shaft 25*b* along arrow B of the heat sink 25 is located inside the second side surface 1*b* of the chassis 1. As shown in FIG. 13, the heat sink 25 slides along arrow B, thereby inserting the support shaft 25*b* into the receiving hole 1*i* of the second side surface 1*b*.

A printing operation of the dye sublimation printer 100 according to the first embodiment will be now described with reference to FIGS. 4 to 6 and 14.

As shown in FIG. 4, the stepping motor 17 is so driven that the motor gear 17*a* mounted thereon rotates along arrow C3 and the feed roller gear 6 rotates along arrow C1 through intermediate gears 22 and 23. Thus, the feed roller 4 rotates along arrow C1, as shown in FIG. 5. Further, the paper feed roller gear 10 and the paper feed roller 9 rotates along arrow C4 through the intermediate gears 20 and 21. Thus, each paper 40 is transported in a paper feed direction (along arrow T1). At this time, a swingable swing gear 19 is not in mesh with the gear portion 13*a* of the take-up reel 13 and hence the gear portion 13*a* of the take-up reel 13 remains unrotating. In the paper feeding operation, therefore, the ink sheet 51 wound on the take-up bobbin 50*c* and the supply bobbin 50*d* is not taken up. The paper sensors 31*a* and 31*b* determine whether or not each paper 40 is transported to a printing position by detecting the front and rear ends of each paper 40.

When the stepping motor 18 (see FIG. 4) drives in a state where each paper 40 is transported to the printing position, the pressing member 24 rotates about the rotating shaft 24*b* along arrow G as shown in FIG. 6. At this time, the protrusion 24*a* engages with the engaging member 26 mounted on the upper surface of the heat sink 25, whereby the heat sink 25 rotates about the plate-like support shafts 25*a* and 25*b* as the axis of rotation employing the sectorial ends 1*j* and 1*k* of the sectorial receiving holes 1*h* and 1*i* as supporting points. Thus, the print head 2 mounted on the heat sink 25 is brought into pressure contact with the platen roller.

As shown in FIG. 4, the stepping motor 17 is so driven that the motor gear 17*a* mounted thereon rotates along arrow D3 and the feed roller gear 6 rotates along arrow D1 through the intermediate gears 22 and 23. Thus, the feed roller 4 rotates along arrow D1, as shown in FIG. 14. Further, the paper discharge roller gear 12 and the paper discharge roller 11 rotates along arrow D5 through the intermediate gears 20 and 21 and the paper feed roller 10. Thus, each paper 40 is transported in the printing direction (along arrow U1). At this time, the swing gear 19 (see FIG. 4) swings along arrow D2 and meshes with the gear portion 13*a* of the take-up reel 13, and the ink sheet 51 wound on the take-up bobbin 50*c* engaging with the take-up reel 13 and the supply bobbin 50*d* is taken up in the direction of the take-up bobbin 50*c*.

According to the first embodiment, when the print head 2 moves in the printing direction (along arrow U1) following to transportation of each paper 40 in the printing direction, the contact portion 25*c* of the heat sink 25 comes into contact with the protrusions 14*f* and 15*i*, as shown in FIG. 14.

Thereafter each printed paper 40 is discharged from the dye sublimation printer 100 after printing the paper 40. At this time, the printed paper 40 is transported along arrow U1, similarly to the operation for printing the paper 40. Then, the printed paper 40 is transported along the upper side of the upper paper guide 8, and discharged by the paper discharge rollers 11 rotating along arrow D5.

According to the first embodiment, as hereinabove described, the dye sublimation printer 100 is provided with the heat sink 25 mounted on the print head 2, radiating heat generated in the print head 2, provided integrally with the plate-like support shafts 25*a* and 25*b* as the axis of rotation and rotatable in the direction for coming into pressure contact with or separating from the platen roller 3, and the chassis 1 having the receiving holes 1*h* and 1*i* receiving the plate-like support shafts 25*a* and 25*b*, whereby no support shaft may be separately mounted and the heat sink 25 can be stably rotated about the support shafts 25*a* and 25*b*. Thus, the print head 2 can be stably brought into pressure contact with or separated from the platen roller 3 while suppressing increase in the number of components of the shaft portion. In this dye sublimation printer 100, the locating portions 14*c* and 15*c* regulating the movement of the print head 2 in the printing direction (along arrow U1 in FIG. 6) of each paper 40 are provided, whereby no function regulating the movement of the print head 2 may be provided in the support shafts 25*a* and 25*b* serving as the axis of rotation, and hence the support shafts 25*a* and 25*b* serving as the axis of rotation and the hole-shaped receiving holes 1*h* and 1*i* may not be worked with high dimensional accuracy.

According to the first embodiment, the side plate 14 integrally includes the stopper portion 14*d* capable of limiting the movement of the support shaft 25*a* of the heat sink 25 in the axial direction, and the stopper portion 14*d* is so formed as to be elastically deformable in the direction intersecting with the axial direction of the support shaft 25*a* up to the position where the stopper portion 14*d* does not come into contact with the plate-like support shaft 25*a* inserted into the receiving hole 1*h*, whereby the stopper portion 14*d* can be deformed so as not to come into contact with the support shaft 25*a* when the plate-like support shaft 25*a* is inserted into the receiving hole 1*h*. Thus, the plate-like support shaft 25*a* can be easily inserted into the receiving hole 1*h*.

According to the first embodiment, the receiving holes 1*h* and 1*i* receiving the plate-like support shafts 25*a* and 25*b* respectively are each formed in a sectorial shape, whereby the plate-like support shafts 25*a* and 25*b* can be rotated about the sectorial ends 1*j* and 11*k* as the supporting points and hence the heat sink 25 can be further stably rotated.

According to the first embodiment, the stopper portion 14*d* is provided on the side plate 14 across the receiving hole 1*h*, whereby the plate-like support shaft 25*a* inserted into the receiving hole 1*h* can be easily brought into contact with the stopper portion 14*d* and hence the stopper portion 14*d* can easily regulate the movement of the support shaft 25*a* in the axial direction (along arrows A and B).

According to the first embodiment, the protrusions 14*f* and 15*i* protruding toward the print head 2 (along arrow E) are provided on the locating portions 14*c* and 15*c* respectively, whereby the print head 2 moving in the printing direction (along arrow F) of the papers 40 in printing can be easily brought into contact with the protrusions 14*f* and 15*i* and hence the movement of the print head 2 in the printing direction (along arrow F) of the papers 40 can be easily regulated.

Second Embodiment

A structure of a dye sublimation printer 200 according to a second embodiment of the present invention will be now described with reference to FIGS. 12, 13 and 17 to 26. In the dye sublimation printer 200 according to the second embodiment, a heat sink 202 includes a pushed-up portion 202*d* pushed up with a pressing member 201 when the pressing member 201 rotates, dissimilarly to the dye sublimation printer 100 according to the aforementioned first embodiment.

Figure 17:
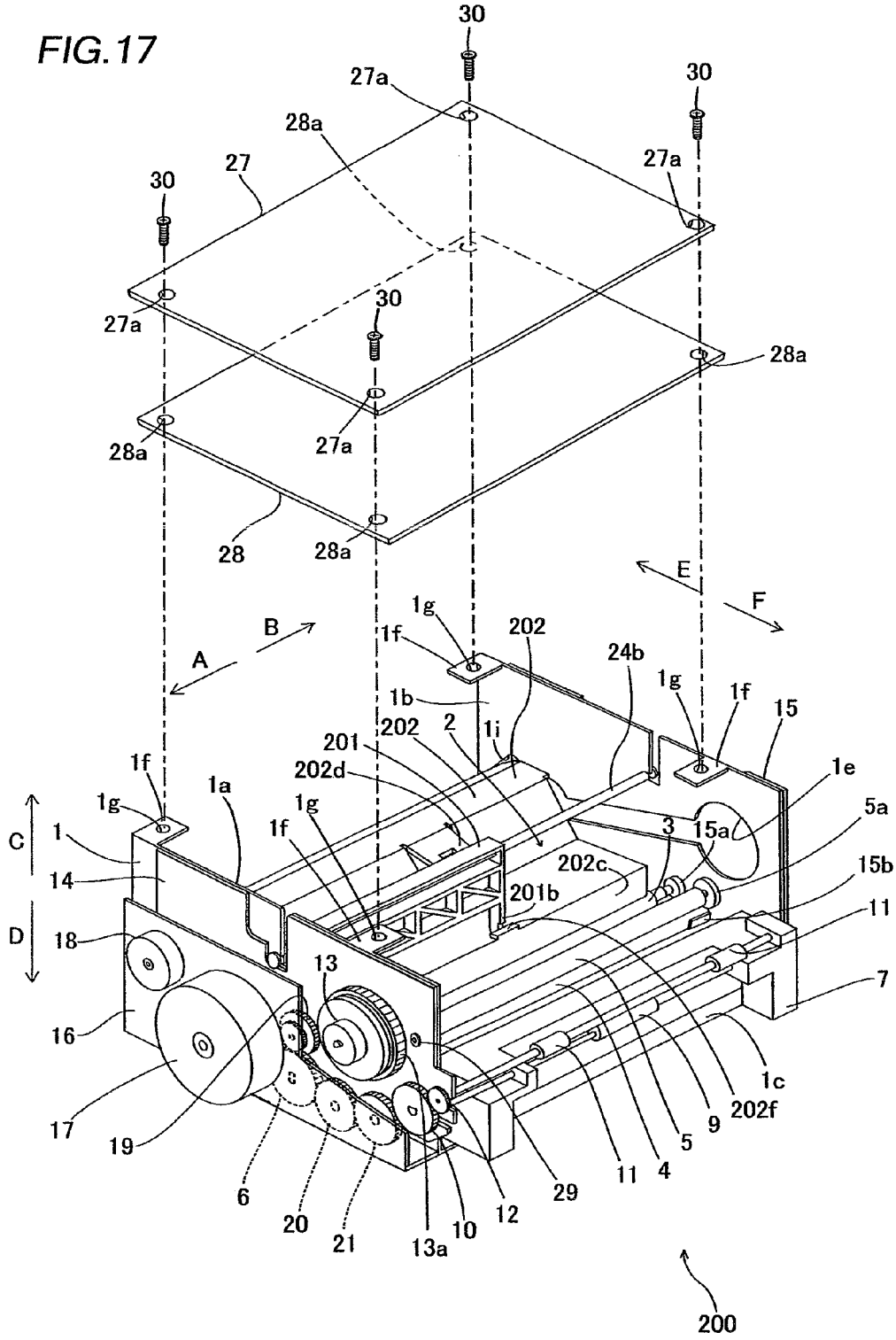
FIG. 17 is a perspective view showing an overall structure of a dye sublimation printer according to a second embodiment of the present invention.

As shown in FIG. 17, the dye sublimation printer 200 according to the second embodiment comprises the pressing member 201 made of resin for pressing a print head 2, and the heat sink 202 mounted on the print head 2 and radiating heat generated in the print head 2. The heat sink 202 is an example of the "heat radiating member" in the present invention.

Figure 18:
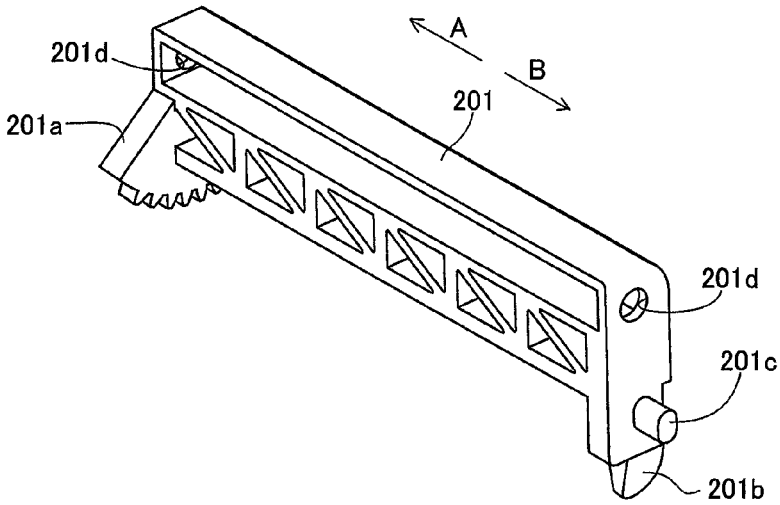
FIG. 18 is a perspective view showing a pressing member of the dye sublimation printer according to the second embodiment of the present invention shown in FIG. 17.
Figure 19:
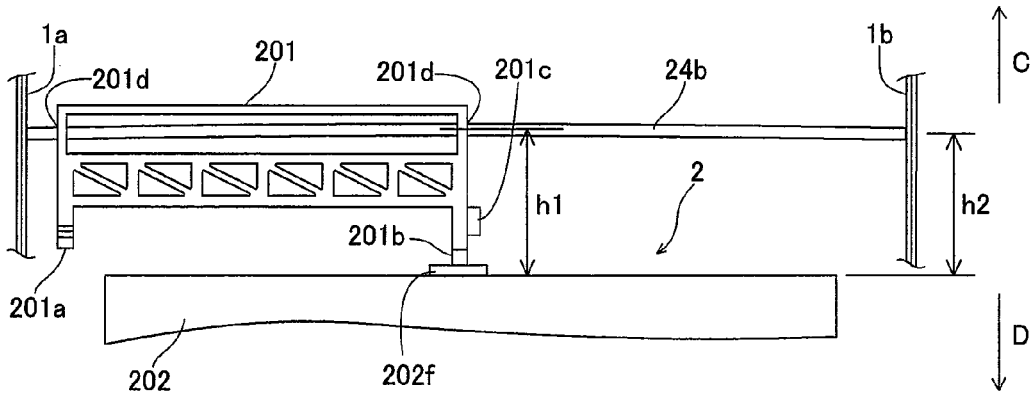
FIG. 19 is a diagram for illustrating a pressing member of the dye sublimation printer according to the second embodiment of the present invention shown in FIG. 17.

According to the second embodiment, an end along arrow A of the pressing member 201 is formed integrally with a sectorial gear portion 201*a*, as shown in FIG. 18. An end along arrow B of the pressing member 201 is formed integrally with a pressing portion 201*b* pressing the print head 2. A protrusion 201*c* is so provided on a side surface along arrow B of the pressing member 201 as to protrude outward. Receiving holes 201*d* receiving a rotating shaft 24*b* are formed on the both side surface along arrows A and B of the pressing member 201. The pressing member 201 is so formed as to be rotatable about the rotating shaft 24*b* in a state where the rotating shaft 24*b* is inserted into the receiving holes 201*d*. The receiving holes 201*d* are each formed such that the distance h1 from an upper surface of the print head 2 to each receiving hole 201*d* is larger than the distance h2 from the upper surface of the print head 2 to a bearing of a rotating shaft 24*b* provided on a second side surface 1*b* of a chassis 1 in a state where the pressing portion 201*b* is in contact with the upper surface of the print head 2 in printing. Thus, the rotating shaft 24*b* is deflected such that a center in an axial direction protrudes upward (along arrow C) in the state where the pressing portion 201*b* is in contact with the upper surface of the print head 2 in printing and hence the print head 2 is pressed from an upper side to an lower side (along arrow D) through the pressing portion 201*b* with downward restoring force of the rotating shaft 24*b*. Consequently, the print head 2 is pressed toward a platen roller 3 (along arrow D) in printing (see FIG. 26).

The gear portion 201*a* meshes with a pressing member rotating gear (not shown) so that motive force of the stepping motor 18 is transmitted to rotate the pressing member 201.

Figure 20:
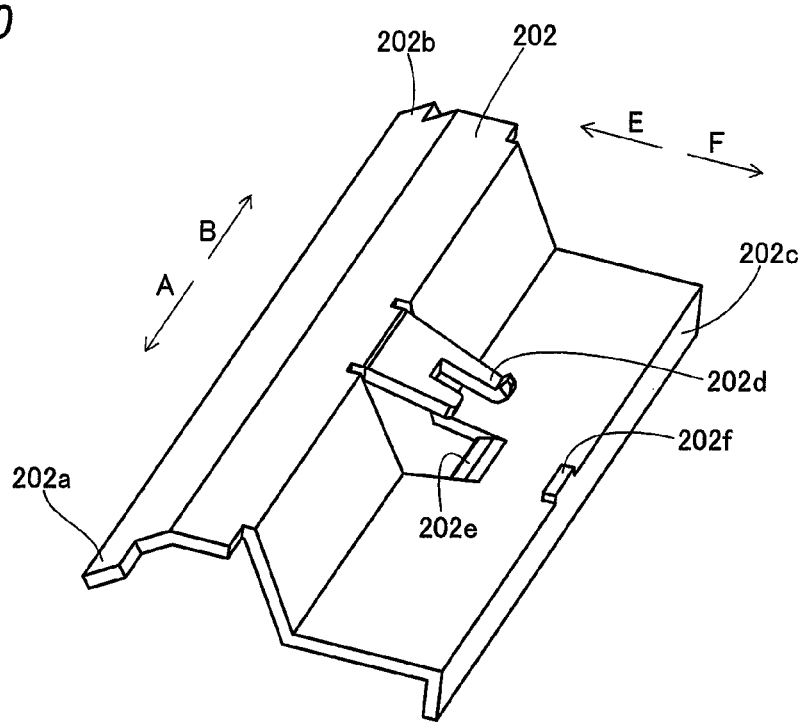
FIGS. 20 and 21 are perspective views showing a heat sink of the dye sublimation printer according to the second embodiment of the present invention shown in FIG. 17.
Figure 21:
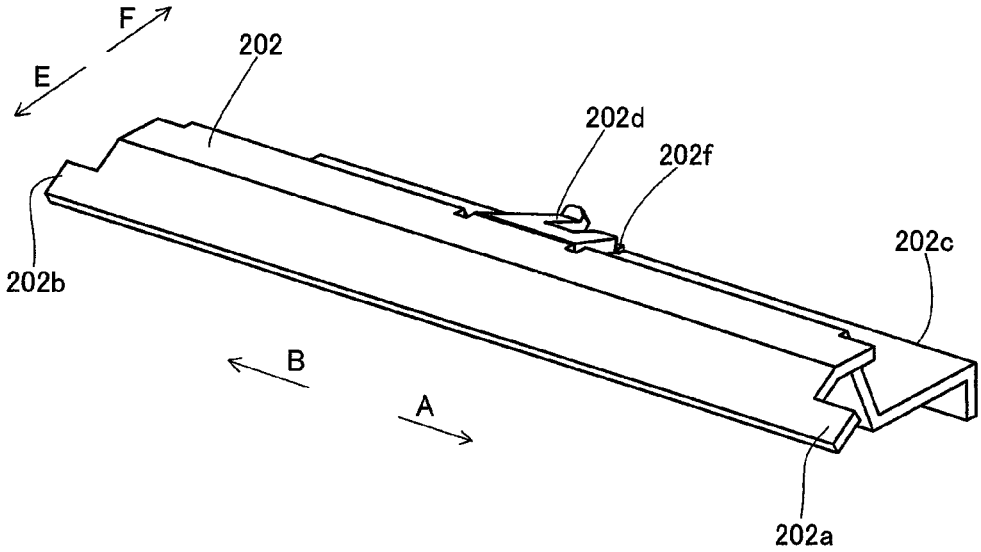
Figure 22:
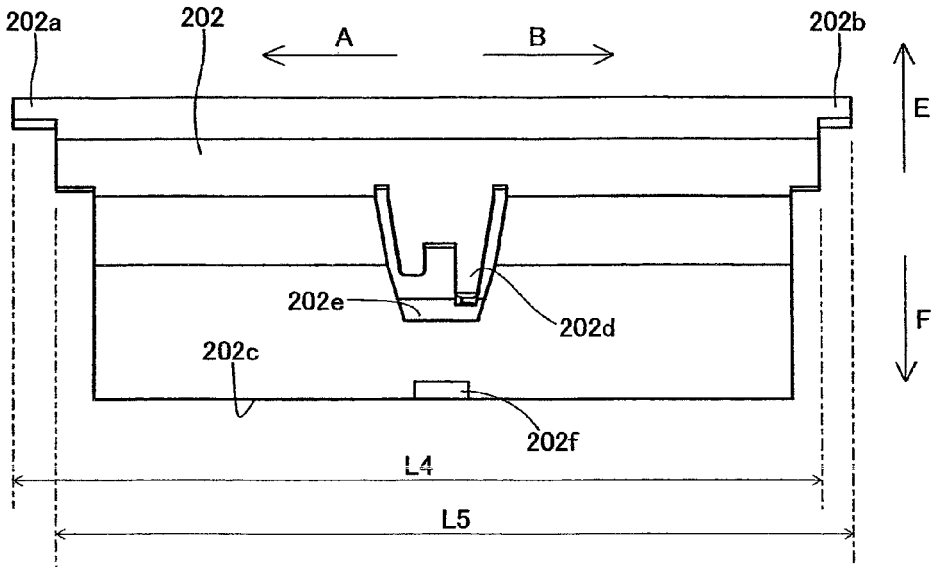
FIG. 22 is a diagram for illustrating the heat sink of the dye sublimation printer according to the second embodiment of the present invention shown in FIG. 17.

According to the second embodiment, the heat sink 202 is formed integrally with plate-like support shafts 202*a* and 202*b* protruding outward from a first end surface portion (end surface portion along arrow A) and a second end surface portion (end surface portion along arrow B) along arrow E respectively and a contact portion 202*c* along arrow F, as shown in FIGS. 20 to 22. The pushed-up portion 202*d* pushed up with the protrusion 201*c* of the pressing member 201 when the pressing member 201 rotates upward is integrally formed on the center of the heat sink 202 by partially uprighting. Thus, the pushed-up portion 202*d* of the heat sink 202 is pushed up with the protrusion 201*c* of the pressing member 201 when the pressing member 201 rotates upward, and consequently the print head 2 is rotated in a direction for separating from the platen roller 3, as shown in FIG. 23.

Figure 24:
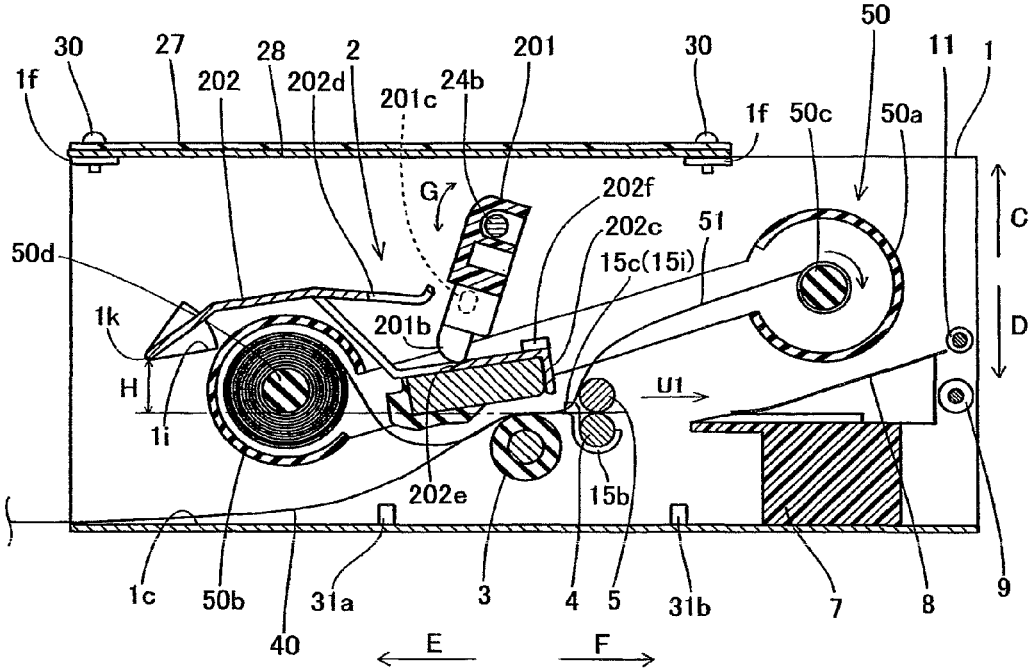

An edge 202*e* of an opening formed after forming the pushed-up portion 202*d* by partially uprighting is formed so as to be smoothly inclined in a vertical direction (along arrows C and D). Thus, the pressing portion 201*b* of the pressing member 201 smoothly slides on the edge 202*e* when the pressing member 201 rotates downward (along arrow D) and hence the pressing portion 201*b* can be easily moved to an upper surface of the heat sink 202, as shown in FIGS. 24 and 25.

Figure 25:
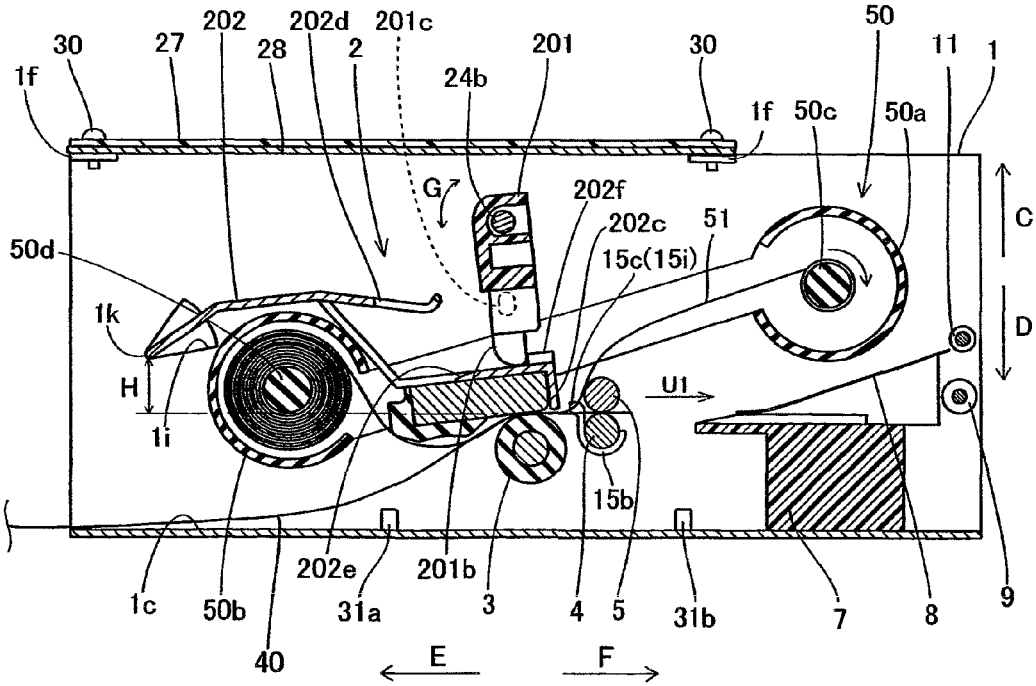
Figure 26:
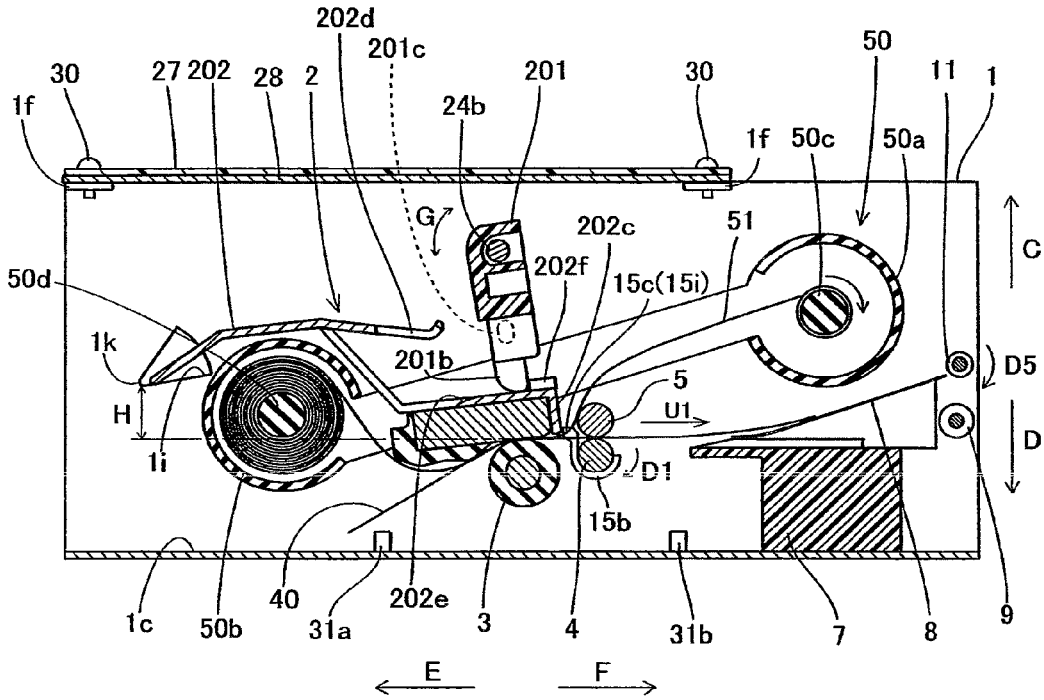

As shown in FIGS. 25 and 26, a deviation stopper 202*f* for preventing the pressing member 201 from deviating in a rotational direction (along arrow F) when the pressing portion 201*b* rotates to reach the upper surface of the heat sink 202 is integrally formed with an end along arrow F of the upper surface of the heat sink 202.

Figure 23:
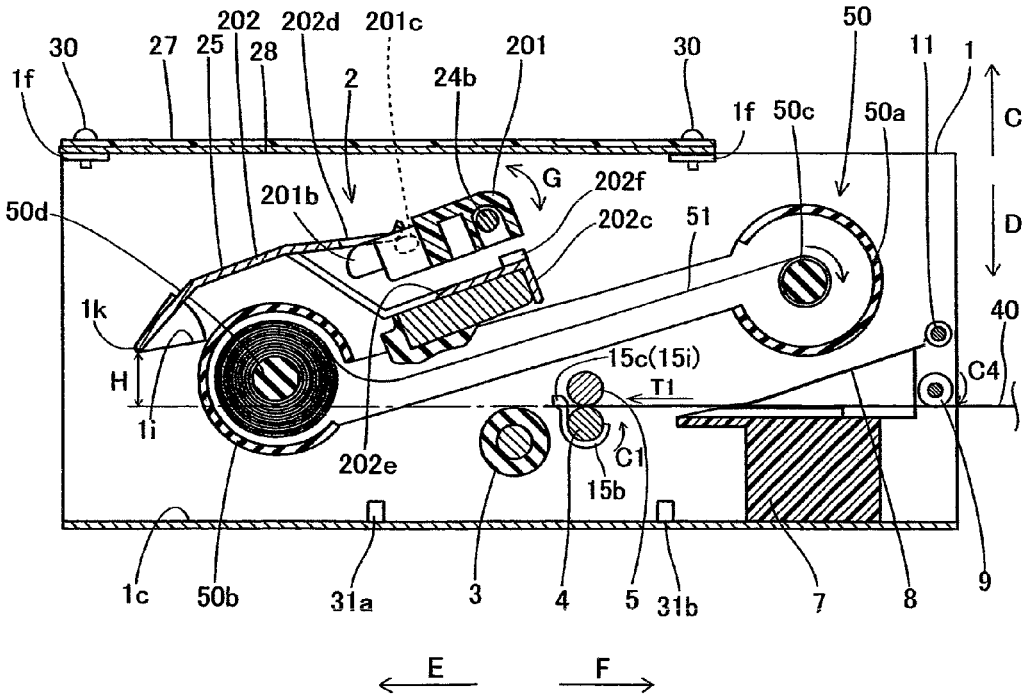
FIGS. 23 to 26 are sectional views of the dye sublimation printer according to the second embodiment of the present invention shown in FIG. 17.

As shown in FIG. 23, the length L4 from an end of the support shaft 202*a* provided on the first end surface portion along arrow A to the second end surface portion along arrow B of the heat sink 202 is larger than the length L2 (see FIGS. 12 and 13) from a first side surface 1*a* of the chassis 1 to the second side surface 1*b*. The length L5 from an end of the support shaft 202*b* provided on the second end surface portion along arrow B to the first end surface portion along arrow A of the heat sink 202 is smaller than the length L2 (see FIGS. 12 and 13) from the first side surface 1*a* of the chassis 1 to the second side surface 1*b*. Thus, the end of the support shaft 202*b* is located inside the second side surface 1*b* of the chassis 1 when the support shaft 202*a* is inserted into the receiving hole 1*h* of the first side surface 1*a* up to a position where the first end surface portion along arrow A of the heat sink 202 comes into contact with the first side surface 1*a* of the chassis 1, and hence the support shaft 202*b* can be easily inserted into the receiving hole 1*i* of the second side surface 1*b*.

As shown in FIG. 26, when the contact portion 202*c* of the heat sink 202 is formed so as to come into contact with protrusions 14*f* and 15*i* of locating portions 14*c* and 15*c* provided integrally with the feed roller bearings 14*b* and 15*b* of the side plates 14 and 15 respectively when the print head 2 moves in the printing direction (along arrow U1 in FIG. 14) of each paper 40 in printing. At this time, the deviation stopper 202*f* of the heat sink 202 prevents the pressing member 201 from deviating in the rotational direction (along arrow G) and hence the pressing member 201 can reliably press the print head 2 toward the platen roller 3.

The remaining structure of the dye sublimation printer 200 according to the second embodiment is similar to that of the dye sublimation printer according to the aforementioned first embodiment.

According to the second embodiment, as hereinabove described, the pressing member 201 rotatably formed and pressing the print head 2 toward the platen roller 3 is provided, the pushed-up portion 202*d* pressed with the pressing member 201 when the pressing member 201 rotates is integrally provided on the heat sink 202, and the pushed-up portion 202*d* of the heat sink 202 is pushed up with the pressing member 201 when the pressing member 201 rotates so that the heat sink 202 and the print head 2 rotates in a direction for separating from the platen roller 3, whereby the pushed-up portion 202*d* is pushed up with rotating force of the pressing member 201 when the pressing member 201 rotates without separately providing a transfer mechanism portion transmitting rotating force of the pressing member 201 to the heat sink 202 and the print head 2 and the heat sink 202 and the print head 2 can be easily rotated in the direction for separating from the platen roller 3. Consequently, increase in the number of components can be suppressed.

According to the second embodiment, the print head 2 is so formed as to be pressed toward the platen roller 3 with the pressing member 201 in printing, and the deviation stopper 202*f* preventing the pressing member 201 from deviating in the rotational direction when the pressing member 201 presses the print head 2 toward the platen roller 3 in printing is provided on the heat sink 202, whereby the pressing member 201 does not deviate in the rotational direction in printing, and hence the pressing member 201 can reliably press the print head 2 toward the platen roller 3.

According to the second embodiment, the pressing member 201 is made of resin, whereby noise can be suppressed also when the pressing member 201 slides with respect to the rotating shaft 24*b* made of metal at the time of rotation of the pressing member 201, as compared with a case where the pressing member 201 is made of metal.

The remaining effects of the second embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while each of the aforementioned first and second embodiments is applied to the dye sublimation printer employed as an exemplary image generating apparatus, the present invention is not restricted to this but is also applicable to another image generating apparatus other than the dye sublimation printer so far as the image generating apparatus comprises a heat radiating member.

While the stopper portion is integrally provided on the side plate in each of the aforementioned first and second embodiments, the present invention is not restricted to this but a stopper portion may alternatively be provided on the side plate as a separate member.

While the receiving holes are each formed in a sectorial shape in each of the aforementioned first and second embodiments, the present invention is not restricted to this but each receiving hole may be alternatively formed in another shape so far as the receiving hole can receive and rotate the plate-like support shaft.

While the locating portions are integrally provided on the feed roller bearings in each of the aforementioned first and second embodiments, the present invention is not restricted to this but the locating portions may alternatively be provided separately from the feed roller bearings.

What is claimed is:

1. An image generating apparatus comprising:

a print portion printing a paper;

a platen roller arranged so as to be opposed to said print portion;

a heat radiating member mounted on said print portion, radiating heat generated in said print portion, integrally provided with a plate-like support shaft as an axis of rotation and rotatable in a direction for coming into pressure contact with or separating from said platen roller;

a regulating member regulating movement of said print portion in a printing direction of said paper;

a chassis having a hole-shaped bearing receiving said plate-like support shaft; and a side plate mounted on said chassis;

wherein:

said side plate integrally includes a contact portion capable of limiting movement of said support shaft of said heat radiating member in an axial direction, and said contact portion is so formed as to be elastically deformable in a direction intersecting with the axial direction of said support shaft up to a position where said contact portion does not come into contact with said plate-like support shaft inserted into said hole-shaped bearing.

2. The image generating apparatus according to claim 1, wherein said contact portion is provided on said side plate across said hole-shaped bearing.

3. The image generating apparatus according to claim 1, wherein said hole-shaped bearing receiving said plate-like support shaft is formed in a sectorial shape.

4. The image generating apparatus according to claim 1, wherein said plate-like support shaft includes first and second support shafts integrally provided on said heat radiating member so as to protrude outward from first and second end surface portions of said heat radiating member respectively, and the length from an end of said second support shaft provided on said second end surface portion of said heat radiating member to said first end surface portion of said heat radiating member is smaller than the length from a first side surface of said chassis to a second side surface of said chassis.

5. The image generating apparatus according to claim 1, further comprising a feed roller transporting said paper, wherein said regulating member is so formed as to function as a bearing of said feed roller.

6. The image generating apparatus according to claim 5, wherein said regulating member functioning as the bearing of said feed roller includes a protrusion protruding toward said print portion.

7. The image generating apparatus according to claim 1, further comprising a pressing member rotatably formed and pressing said print portion toward said platen roller, wherein a pushed-up portion pushed up with said pressing member when said pressing member rotates is integrally provided on said heat radiating member, and said pushed-up portion of said heat radiating member is pushed up with said pressing member when said pressing member rotates so that said heat radiating member and said print portion rotate in a direction for separating from said platen roller.

8. The image generating apparatus according to claim 7, wherein said pressing member presses said print portion toward said platen roller in printing, and said heat radiating member includes a deviation stopper preventing said pressing member from deviating in a rotational direction when said pressing member presses said print portion toward said platen roller in printing.

9. The image generating apparatus according to claim 7, wherein said pressing member is made of resin.

10. An image generating apparatus comprising:

a print portion printing a paper;

a platen roller arranged so as to be opposed to said print portion;

a heat radiating member mounted on said print portion and radiating heat generated in said print portion;

a regulating member regulating movement of said print portion in a printing direction of said paper;

a chassis;

a side plate mounted on said chassis; and a feed roller transporting said paper, wherein said heat radiating member is formed integrally with a plate-like support shaft as an axis of rotation and rotates in a direction for coming into pressure contact with or separating from said platen roller, said chassis has a sectorial hole-shaped bearing receiving said plate-like support shaft, said side plate integrally includes a contact portion capable of limiting movement of said support shaft of said heat radiating member in an axial direction, said contact portion is elastically deformed in a direction intersecting with the axial direction of said support shaft up to a position where said contact portion does not come into contact with said plate-like support shaft inserted into said hole-shaped bearing, said plate-like support shaft includes first and second support shafts integrally provided on said heat radiating member so as to protrude outward from first and second end surface portions of said heat radiating member respectively, the length from an end of said second support shaft provided on said second end surface portion of said heat radiating member to said first end surface portion of said heat radiating member is smaller than the length from a first side surface of said chassis to a second side surface of said chassis, and said regulating member is so formed as to function as a bearing of said feed roller.

11. The image generating apparatus according to claim 10, wherein said contact portion is provided on said side plate across said hole-shaped bearing.

12. The image generating apparatus according to claim 10, wherein said regulating member functioning as the bearing of said feed roller includes a protrusion protruding toward said print portion.

13. The image generating apparatus according to claim 10, further comprising a pressing member rotatably formed and pressing said print portion toward said platen roller, wherein a pushed-up portion pushed up with said pressing member when said pressing member rotates is integrally provided on said heat radiating member, and said pushed-up portion of said heat radiating member is pushed up with said pressing member when said pressing member rotates so that said heat radiating member and said print portion rotate in a direction for separating from said platen roller.

14. The image generating apparatus according to claim 13, wherein said pressing member presses said print portion toward said platen roller in printing, and said heat radiating member includes a deviation stopper preventing said pressing member from deviating in a rotational direction when said pressing member presses said print portion toward said platen roller in printing.

15. The image generating apparatus according to claim 13, wherein said pressing member is made of resin.

* * * * *